US005163887A

United States Patent [19]

Hatch

[11] Patent Number: 5,163,887

[45] Date of Patent: Nov. 17, 1992

[54] WEIGHT COLLAR

[76] Inventor: Donald C. Hatch, 38 Cayuga Rd., Sea Ranch Lakes, Fla. 33308

[21] Appl. No.: 751,743

[22] Filed: Aug. 29, 1991

[51] Int. Cl.[5] ..... A63B 21/072

[52] U.S. Cl. ..... 482/107; 482/106

[58] Field of Search ..... 272/122, 123; 403/351, 403/374; 24/635; 411/348, 432, 433

[56] References Cited

U.S. PATENT DOCUMENTS

| | | | |
|---|---|---|---|
| 4,074,923 | 2/1978 | Howe, Jr. | 403/351 |
| 4,579,337 | 4/1986 | Uyeda | 272/123 |
| 4,585,367 | 4/1986 | Gall | 272/123 |
| 4,738,446 | 4/1988 | Miles | 272/123 |
| 4,773,641 | 9/1988 | Metz | 272/123 |
| 4,893,810 | 1/1990 | Lee | 272/123 |
| 5,062,631 | 11/1991 | Dau et al. | 272/123 |

FOREIGN PATENT DOCUMENTS

| | | | |
|---|---|---|---|
| 0251922 | 12/1987 | German Democratic Rep. | 272/123 |
| 2162076 | 1/1986 | United Kingdom | 272/123 |

*Primary Examiner*—Vincent Millin
*Assistant Examiner*—Lynne A. Reichard
*Attorney, Agent, or Firm*—Malin, Haley, McHale, DiMaggio & Crosby

[57] ABSTRACT

An improved quick release weight collar for securing removable weights on a weight bar. The collar has two connected cylindrical members integrally joined by one or more steel balls that can be locked in a first position against the bar radially and rotatably unlocked relative radially to the bar in a second position.

6 Claims, 1 Drawing Sheet

CLOSED

RELEASED

WEIGHT COLLAR

BACKGROUND OF THE INVENTION

1. Field of the Invention

This invention relates to a device for releaseably securing removable weights on a weight bar, and in particular to a quick release weight bar collar that is used to removably fasten a plurality of removable weights to a weight bar.

2. Description of the Prior Art

A barbell is used for lifting weights, for exercise and sport. A barbell is typically comprised of a rigid bar having changeable weights of equal value at both ends. A weight collar is a device that attaches at each end of a barbell to secure the weights to the bar. Multiple disk-shaped weights can be mounted at each end of the barbell to vary the weight value being lifted by the user. Often the lifting person, during a weight lifting work out, must employ different mass weights for different exercises. To change weights requires removal and reinstallation of the weight collar on each end of the bar. A quick release weight collar is desirable to save time. However, because the weights are individually heavy, it is essential that each weight be securely fastened to the bar at all times during exercises when the barbell is being used. Many of the weight collars shown in the prior art, while securely fastening one or more weights to the bar, are time consuming to operate when changing the weights on the bar. In an attempt to alleviate this problem, U.S. Pat. No. 4,893,810 shows a partial quick release mechanism that utilizes an internal mechanical spring and spring tension to engage the weight collar to the bar. Manually overcoming the spring tension allows for a quick release of the weight collar from the bar. Mechanical spring action does not over time and usage secure the weight collar to the bar as firmly as desired. The weight collar in accordance with the present invention eliminates the spring and spring action and provides for a reliable quick release when necessary, while maintaining a secure grip on the bar when locked to prevent movement of the weights on the bar.

SUMMARY OF THE INVENTION

A weight collar for securing removable weights to a barbell shaft comprising a first rigid cylindrical inner body, having one or more adjustable bar locking members mounted thereon sized in diameter to fit concentrically around the barbell bar shaft and also concentrically within an outer cylindrical body. The inner body is attached within the outer body by a plurality of rigid spheres disposed in apertures in the inner body surface and in a helically grooved track on the inner surface of the outer body. The rigid spheres are loose fitting when in position at one end of the outer body and but can be tightened against the bar by rotation of the outer body relative to the inner body, which moves the spheres toward the opposite end of the outer body where the grooves have a smaller diameter across the outer body forcing the rigid spheres radially inward against the weight bar. Typically two weight collars are used with each weight bar, one at each end of the weight bar.

The weight collar operates in two separate modes (release and lock) determined by the relative position of the inner body to the outer body which positions the rigid spheres longitudinally and radially inward.

The bar locking members are comprised of a plurality of rigid spheres such as steel spherical balls which are individually mounted in circular apertures located at strategic locations along the surface of the inner cylindrical body, which may be constructed of metal or rigid plastic.

The outer body has a grooved longitudinal path semicircular in cross-section which is helical from end to end on the inside surface of the outer body sized to receive the steel balls as a track to guide movement of the balls. The grooved track diameter measured diametrically across the inner surface of the outer body decreases from one end of the outer body to the other end. This diameter difference moves the steel balls inwardly, radially at one end forcing the steel balls to engage a weight bar surface for locking.

The inner body includes an enlarged annular flange at one end for ease in installing the collar over the bar end and to hold against the weight. The weight collar in accordance with the present invention is sized to be used with a barbell or a weight bar of a specific diameter so that in the fully locked position, each weight collar and particularly each rigid sphere firmly engages the outside surface of the weight bar preventing the weight collar from moving longitudinally along the barbell shaft or rotationally unless and until the outer body is manually rotated relative to the inner body, releasing the inward radial force on the spheres.

To prepare the weight collar for installation on a barbell, the inner body is first rotated relative to the outer body until the flared end of the inner body is extended away from the outer body and the inner body stops moving. The weight collar flaired end is then positioned concentrically on the weight bar and pushed against the weights selected in flush engagement. Once the collar is positioned on the bar pressing against the weights, the collar outer body is coaxially and longitudinally rotated toward the flaired end of the inner body, moving the rigid spheres in the helical paths. During movement of the spheres, the space between the rigid spheres and the grooved track gets smaller radially causing each sphere to be pressed radially inwardly, against the barbell bar outer surface. Once each rigid sphere has reached the position where each is firmly pressed by the grooved path surface, each sphere is frictionally locked to the outside surface of the weight bar and the inner body aperture, preventing movement longitudinally or rotationally along the bar.

To remove the weight collar from the barbell, the outer body is manually grasped and rotated relative to the inner body which internally moves the position of the rigid spheres relative to the helical grooved path, moving the spheres to a location along the helical grooved path where the inside diameter of the outer member increases, causing the rigid spheres to become loose in their aperture mounts thus releasing pressure and frictional contact with the weight bar. In the release position, the weight collar easily slides along and off the bar.

The present invention may include an inner body and an outer body made of a rigid material such as metal, steel or a rigid plastic. In actual use, a pair of weight collars in accordance with the invention would be used, one on each side of the weight bar, for each end of the weight bar.

It is an object of this invention to provide an improved weight collar for use on a barbell for weight lifting.

It is another object of this invention to provide an improved weight collar that can be quickly released from the weight bar while holding the removable weights securely in place.

Yet still another object of this invention is to provide a small reliable, easy to operate, weight collar that can securely hold weights in place while being extremely easy to operate for fast removal of the weight collar and weights when necessary.

In accordance with these and other objects which will be apparent hereinafter, the instant invention will now be described with particular reference to the accompanying drawings.

PREFERRED EMBODIMENT OF THE INVENTION

Figure 1:
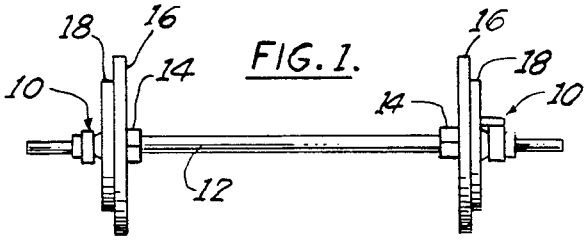
FIG. 1 shows a front elevational view of a barbell which includes weights, a weight bar and a pair of weight collars in accordance with the present invention.

Referring now to the drawings and specifically FIG. 1, a barbell or weight bar 12 is shown with weight locks 14 adjacent the insides of pairs of removable weights 16 and 18. The weights 18 (and consequently 16) are secured in position by the present invention, weight collar 10 on each outside end of weight bar 12. As shown in FIG. 1, the weight collars 10 are the elements closer to each end of the bar 12. With the weight collar 10 in this position, the weights 18 are firmly held in place in conjunction with weight lock 14. Whenever the weights 16 and 18 need to be removed from the bar 12, each weight collar 10 can be individually released as described herein and removed from each end of the weight bar 12 to permit the weights 16 and 18 to be changed as desired. New weights may be added to the bar 12 and the weight collar 10 is then installed on each side of weight bar 12.

Figure 2:
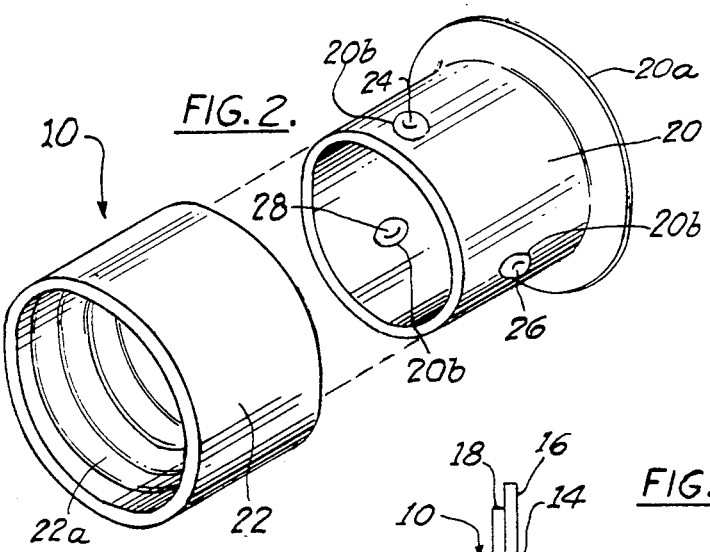
FIG. 2 shows a perspective, exploded view of the present invention from the front side (flaired inner body end 20*a* is used to abut a weight, not shown).

Referring now to FIG. 2, the present invention is shown generally at 10 comprised of a rigid cylindrical inner body 20 having an annular flair or flanged end portion 20*a*, the inner body fitting coaxially within an outer cylinder body 22. The outer body 22 has a grooved inside surface track 22*a* that extends helically from one inside end to the other end of outer body 22.

The purpose of the grooved path or track 22*a* around the inside surface of outer member 22 is to receive and house one or more rigid spheres such as spherical steel balls 24, 26 and 28 which are also mounted such that a partial segment of each ball rests in circular aperture or socket 20*b* protruding through the wall of inner body 20. The diameter of each aperture 20*b* is smaller than the diameter of the balls 24, 26 and 28 so that each ball rests on socket rim 20*b* on the outer surface of inner body 20 with a small amount of the volume of spherical ball body protruding radially inwardly through aperture 20*b* into the inside volume of and above the inside surface of inner body 20 within which the weight bar segment would be positioned. In the collar release position, the balls 24, 26 and 28 are loose in their sockets. Rotating inner body 20 relative to the outer body 22 forces the ball bearings to move along track 22*a* from near one end of outer body 22 to the opposite end. During such movement from the release position to the locked position, each ball 24, 26 and 28 is pushed or forced radially inwardly firmly into each socket 20*b* by the inner track grooved surface whose helical diameter decreases toward one end. Ultimately the balls reach a point along the track of firm contact and engagement with the weight bar, resulting in the weight collar locked position wherein the collar cannot move along the bar. The diameter of each ball 24, 26 and 28 is also sized to fit and move in the helical grooved path 22*a* in the inside surface of outer body 22. Thus with the inner body in place and three balls 24, 26 and 28 as shown, protruding substantially on the outside surface of inner body 20, the balls 24, 26 and 28 are spaced longitudinally along the inner body to engage different segments of the helically grooved path 22*a* on the inside surface of outer body 22. The balls also prevent the inner body from being disengaged from the outer body 22. The only relative motion permitted between the inner body and the outer body is rotational (clockwise or counterclockwise) occasioned by the balls 24, 26 and 28 moving in the grooved path 22*a*. The track 22*b* includes a stop at each end that limits the travel of the balls so that the inner body does not separate from the outer body.

The inner body 20 also includes one flared or flanged annular end having an enlarged end diameter which exceeds that of the mid-section of the inner body 20 but not the outside of outer body 22 to allow ease of installation for mounting the collar 10 over the end of the weight bar and further for engagement with a large area with a weight 18 (FIG. 1) to firmly hold the weight in the locked position.

Figure 3:
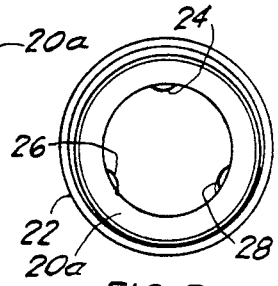
FIG. 3 shows a back elevational view of the present invention.

FIG. 3 shows an end view looking toward the rear face of flanged end 20*a* of inner body 20. This view allows a small portion of each ball 24, 26 and 28 to be seen along the inside longitudinal surface of body 20.

Figure 4:
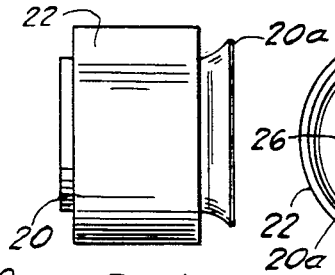
FIG. 4 shows a side elevational view of the present invention in the locked position.

FIG. 4 shows the present invention in what represents a locked position with the inner body 20 moved longitudinally as far as it will go towards one end of the outer body 22. The flared end 20*a* engages the removable weight on the bar in the locked position.

Figure 5:
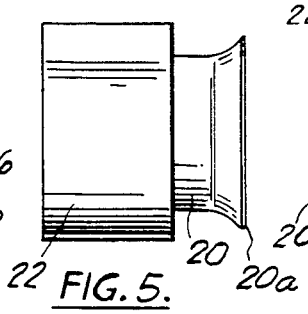
FIG. 5 shows a side elevational view of the present invention in the release position.

FIG. 5 shows the present invention in the released position with the inner body 20 moved longitudinally to the right extending as far as it will go relative to the outer body 22.

Figure 6:
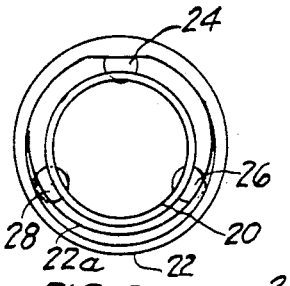
FIG. 6 shows a front elevational view of the present invention.

FIG. 6 shows a front end elevational view facing the end of the device away from the protruding surface 20*a*.

Figure 7:
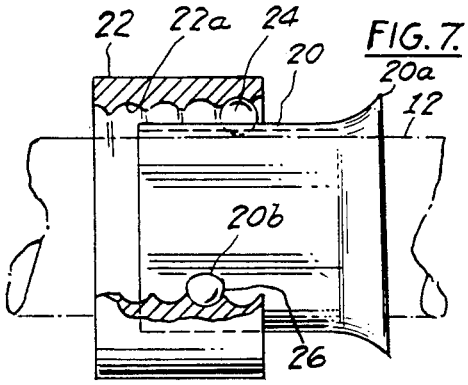
FIG. 7 shows a side elevational view partially cutaway in cross section of the present invention in the release position.

Referring now to FIG. 7, the operation of the invention will be described. In FIG. 7 one can note that balls 24 and 26 are resting in helical grooved path 22*a*, with the inner body 20 being disposed longitudinally to the right to represent the "release" position caused by the size of the inside diameter of the grooved track 22*a* and the longitudinal location of balls 24 and 26. The balls are loose in this position and will loosely ride in the sockets 20*b*. Thus the entire weight collar will slide freely along the longitudinal axis of the weight bar 12 because the diameter of the weight bar is smaller than the diameter of the innermost edge point of each sphere radially when the ball bearings are in the release position.

Figure 8:
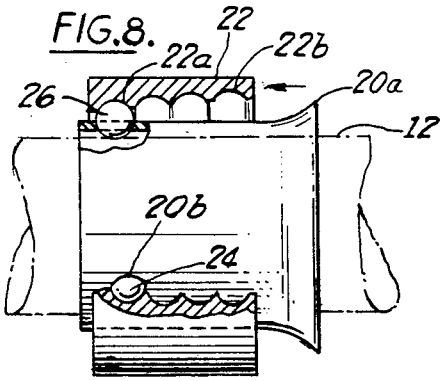
FIG. 8 shows a side elevational view partially cutaway in cross section showing the present invention in the locked position.

Looking at FIG. 8, balls 24 and 26, are at the other end of the outer body 22 in inner surface grooved track 22*a*. In this position because the grooved track diameter is smaller at that end of the outer member 22, the balls 26 and 24 are pushed against the aperture/socket 20*b* because of the reduced space between the groove 22*b* and the inner cylindrical body 20 firmly holding the balls in each socket 20*b* radially into the inside of inner body 20. The balls are sized to engage frictionally and pressure radially inwardly the outer peripheral surface of weight bar 12 causing the entire weight collar to be firmly locked to the outside surface of the weight bar. The only way under normal usage the invention can be moved, once locked, is to rotate the outer body so that the balls 24 and 26 commence rolling towards the larger end diameter of the grooved path (shown at 22*b*) thus releasing the force on the balls causing them to be loose which allows for freedom of movement of the weight collar relative to the weight bar. Not shown in FIGS. 7 and 8 is ball 28.

Thus to operate the device, the configuration in the released mode shown in FIG. 7, is placed over a weight bar (flair end first) and moved in the direction of the longitudinal axis of the weight bar. When the proper position for holding a weight is reached, the outer body is rotated in such direction as to cause the balls 24, 26 and 28 to move to the smaller diameter outer body end, locking the device in place. To remove the device, the reverse action is taken and the inner body is rotated in the opposite direction, causing the balls to move to the opposite end and to be loose so that the entire device can be removed from the barbell.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A weight collar for retaining a removable weight on a weight bar comprising:

first rigid cylindrically shaped hollow body, said first cylindrical body having an outside surface and an inside surface, said inside surface of said first cylindrical body having a grooved path disposed from a first end to a second end, said inside surface grooved path having a cross section that is substantially semicircular and having a predetermined diameter;

at least one rigid sphere having a diameter sized to fit movably in said first cylindrical body inner surface grooved path and mounted in said grooved path;

second rigid cylindrically shaped hollow body sized in diameter to fit concentrically and coaxially inside said first cylindrical body, said second cylindrical body having at least one aperture therethrough sized and shaped to mount and receive a portion of said rigid sphere on the outside of said second cylindrical body while said rigid sphere is mounted in said first cylindrical body grooved path, said second cylindrical body aperture mounting said rigid sphere sized to allow a portion of said rigid sphere to protrude radially inwardly extending above the inside surface of said second cylindrical body radially, said second cylindrical body having an inside diameter sized to concentrically fit around a weight bar, said first cylindrical body having said grooved path on its inside surface having a smaller inside surface diameter at one end of said first cylindrical body and at the opposite end, said device having a first operating position wherein said rigid sphere is disposed at one end of said first cylindrical body grooved path and fits loosely relative to said second cylindrical body while still engaging said first cylindrical body to said second cylindrical body, and a second operating position wherein said rigid sphere is disposed at the opposite end of said first cylindrical grooved body path and said rigid sphere is firmly engaged in said second cylindrical body aperture and protruding in a rigid posture through said second cylindrical body, said rigid sphere protruding sufficiently to firmly engage said weight bar to prevent movement of said weight collar.

2. A weight collar as in claim 1, including:

at least two rigid spheres, said second cylindrical body having at least two apertures, each aperture for receiving a different rigid sphere and each rigid sphere mounted partially within a different aperture having a segment of each rigid sphere extending inwardly through said second cylindrical body, each rigid sphere resting substantially on the outside of said second cylindrical member with a portion of each rigid sphere protruding radially on the inside of said second cylindrical body, each of said rigid spheres being mounted in said first cylindrical body inside grooved path, said first cylindrical body inside grooved path being disposed from one end of said first cylindrical body to the opposite end of said first cylindrical body in the form of a helix path whereby said first cylindrical body is engaged to said second cylindrical body, said first cylindrical body being rotatable relative to said second cylindrical body to position said rigid spheres from a first position disposed towards one end of said second cylindrical body and in a second position relative to the opposite end of said cylindrical body.

3. A weight collar as in claim 2, wherein:

a third rigid sphere, said second cylindrical body having a third aperture which receives and has said third rigid sphere mounted therein, said third rigid sphere being mounted also in said first cylindrical body grooved path, whereby in the second operable position of said weight collar all three of said spheres are rigidly locked in place and protrude sufficiently through said second cylindrical body to firmly engage a weight bar disposed through said second cylindrical body.

4. A weight collar removably lockable to a conventional weight bar having a smooth cylindrical surface comprising:

first rigid cylindrical body having an outside surface and an inside surface and a first and second end, said inside surface having a longitudinal groove disposed from the first end to the second end of said first rigid cylindrical body and;

second rigid cylindrical body concentrically disposed relative to said first cylindrical body;

movable spherical means partially mounted in said first body inner surface groove attaching said first cylindrical body to said second cylindrical body, said second body having an aperture for receiving a partial portion of said spherical means, said spherical means being movable for positioning said spherical means to a first position in a release position with a weight bar disposed through said second cylindrical body and a locked position wherein said spherical means are locked to firmly engage frictionally a weight bar disposed through said second cylindrical body.

5. A weight collar as in claim 4, wherein said first cylindrical body is rotatable relative to said second cylindrical body for establishing said release position and said locked position by rotating said first cylindrical body relative to said second cylindrical body.

6. The weight collar as in claim 5, wherein;

said second rigid cylindrical body having a first annular end and a second annular end, said second annular end being conically flaired and having a larger diameter than said first annular end, said second end being engageable with a disk shaped weight.

* * * * *